United States Patent [19]

Brandt et al.

[11] 4,164,067

[45] Aug. 14, 1979

[54] METHOD OF MANUFACTURING ELECTRICAL RESISTOR ELEMENT

[75] Inventors: Ivan L. Brandt, Milwaukee; Theodor von Alten, Grafton, both of Wis.; Richard E. Voss, Succasunna, N.J.; Oscar L. Denes, Greendale, Wis.

[73] Assignee: Allen-Bradley Company, Milwaukee, Wis.

[21] Appl. No.: 872,411

[22] Filed: Jan. 26, 1978

Related U.S. Application Data

[63] Continuation-in-part of Ser. No. 718,231, Aug. 27, 1976, abandoned.

[51] Int. Cl.[2] ..... H01C 17/00; H01C 7/00

[52] U.S. Cl. ..... 29/620; 29/621; 29/619; 427/101; 338/309

[58] Field of Search ..... 29/610 R, 620, 621, 29/613, 619, 627; 338/308, 309, 312, 333, 276; 252/514; 428/432; 427/101, 103, 100; 228/225, 254, 179

[56] References Cited

U.S. PATENT DOCUMENTS

| | | | |
|---|---|---|---|
| 2,910,766 | 11/1959 | Pritikin | 29/627 |
| 2,924,540 | 2/1960 | D'Andrea | 252/514 |
| 3,056,937 | 10/1962 | Pritikin | 29/620 X |
| 3,103,067 | 9/1963 | Dixon | 228/225 |
| 3,390,452 | 7/1968 | Huang | 29/620 X |
| 3,444,501 | 5/1969 | Delaney et al. | 29/620 X |
| 3,584,379 | 6/1971 | Loose | 29/620 X |
| 3,699,650 | 10/1972 | Cocca | 29/620 |
| 3,914,514 | 10/1975 | MacKenzie et al. | 252/514 X |
| 4,057,777 | 11/1977 | Merz et al. | 29/621 X |
| 4,064,475 | 12/1977 | Kouchich | 29/613 X |
| 4,076,894 | 2/1978 | Langley | 427/101 X |

*Primary Examiner*—Milton S. Mehr
*Attorney, Agent, or Firm*—Arnold J. Ericsen

[57] ABSTRACT

A method of manufacturing a resistor element for fixed or variable resistors. The element comprises an insulating substrate injection molded from ceramic-glass frit material and organic binder and lubricating material and layers of resistive material and conducting termination material deposited on the unfired substrate. The organic materials in the substrate and its termination and resistive layers are substantially "burned out" prior to simultaneously co-firing the substrate and the deposited resistive and termination layers.

The fixed resistor element may be molded as a half-shell arranged to receive leads extending from opposite ends thereof and attached by soldering to the termination areas. A substantially identical cover member molded and fired from the same material as the substrate is adhesively attached to the substrate to complete the resistor.

The invention further contemplates the provision of attaching respective leads by means of forming a solder ball of low melting solder on one end of a solder coated lead and fastening this end by means of a hydrogen torch to the portion of the fixed resistor subassembly containing the termination material.

11 Claims, 19 Drawing Figures

Fig. 1
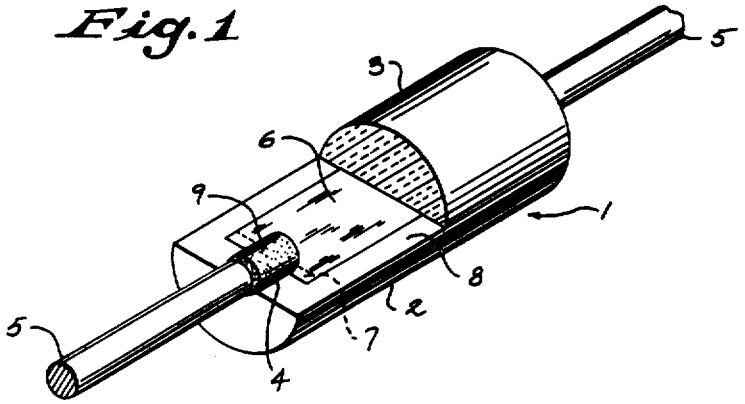
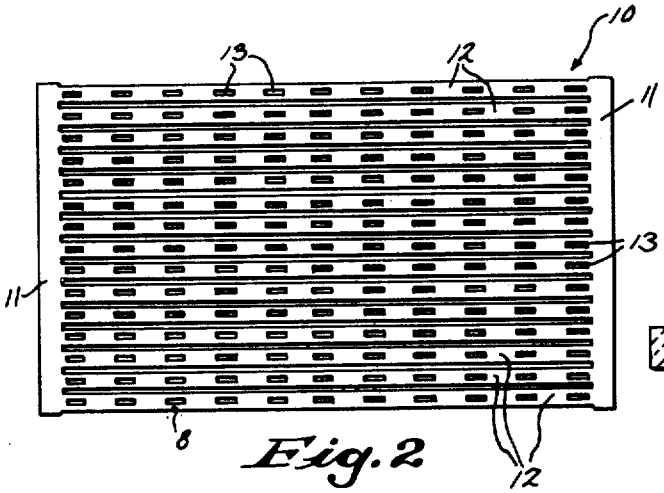
Fig. 2
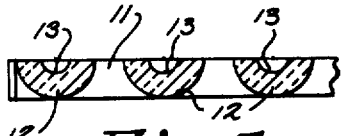
Fig. 5
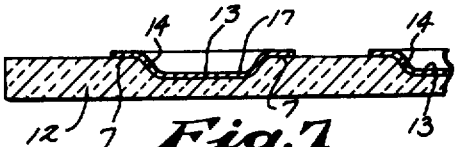
Fig. 7
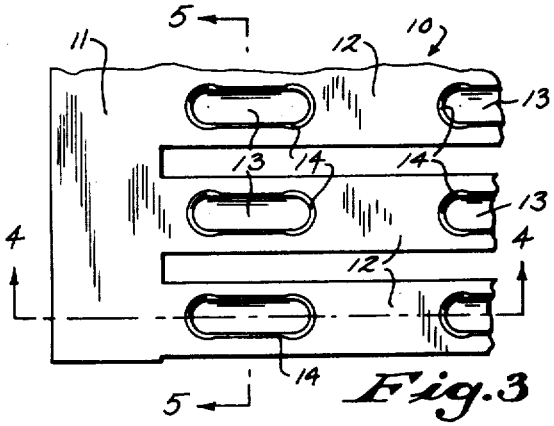
Fig. 3
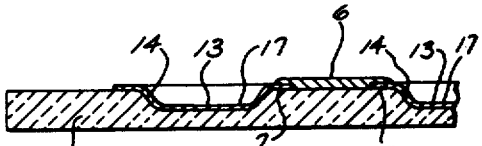
Fig. 8
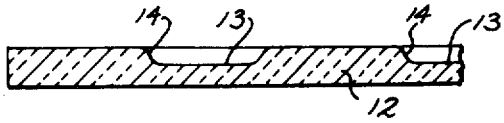
Fig. 4
Fig. 6
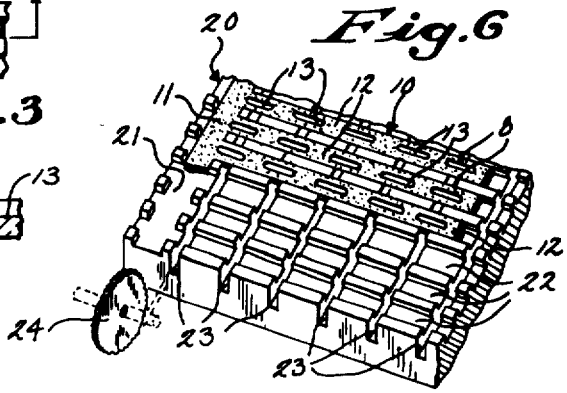

Fig. 9
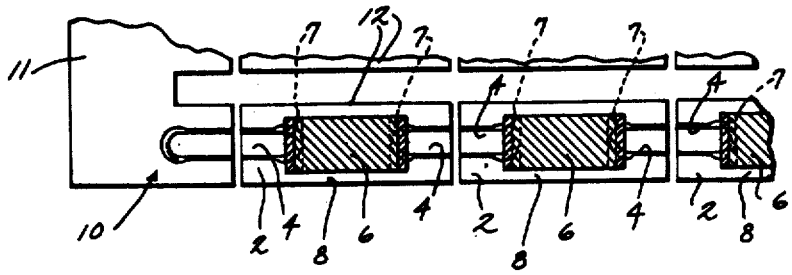
Fig. 10a
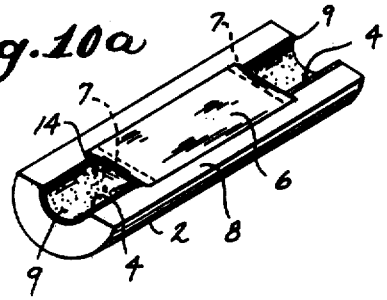
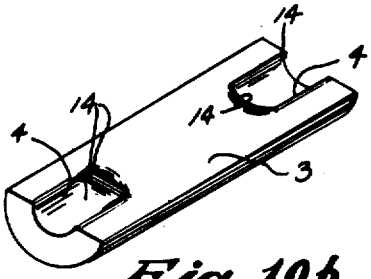
Fig. 10b
Fig. 11
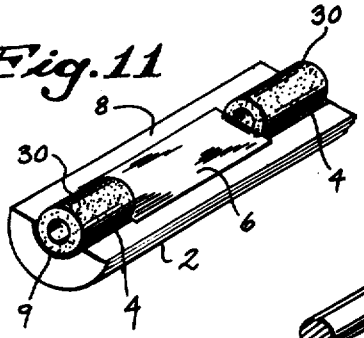
Fig. 12
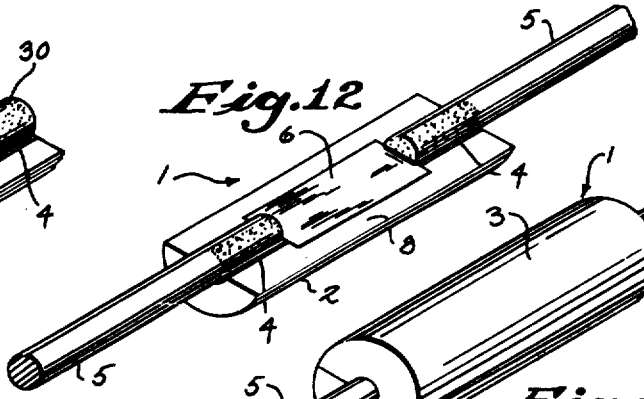
Fig. 13
Fig. 14
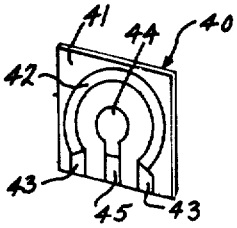
Fig. 15
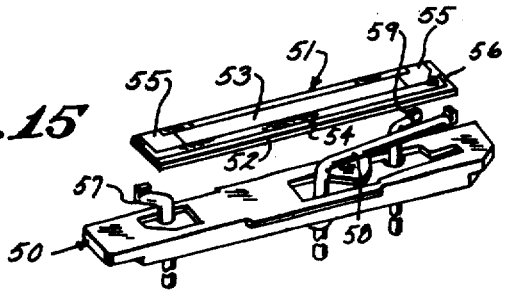

METHOD OF MANUFACTURING ELECTRICAL RESISTOR ELEMENT

RELATED CASE

This is a continuation-in-part of our earlier application Ser. No. 718,231, filed Aug. 27, 1976, now abandoned, and titled "Method of Manufacturing Electrical Resistor Element".

BACKGROUND OF THE INVENTION

1. Field of the Invention

This invention relates to electrical resistors, both fixed and variable, and method for making the same, and particularly relates to resistors commonly known as "thick film" or "cermet" resistors, wherein a glass matrix including conductive materials is deposited on an insulating substrate. The deposited layer or layers are composed so as to include conductive materials of various types, such as noble metals and/or semiconducting oxides of varying consistencies to provide desired resistance values and electrical characteristics and also to provide conductive paths for purposes of termination, where so desired.

2. Description of the Prior Art

Cermet or thick film type resistors were introduced to the market in the early 1960's. In general, the earliest versions were of the type disclosed in the well-known D'Andrea and Dumesnil U.S. Pat. Nos. 2,924,540 and 2,942,992, respectively. D'Andrea taught the use of a composition containing palladium and silver particles in a glass frit, and the Dumesnil patent disclosure was directed to a particular type of glass frit. Both of the disclosures were concerned with depositing resistive or capacitive layers on a prefired insulating substrate, such as barium titanate or other prefired substrate, which could be glass, porcelain, or other refractory.

Earlier, one Nathan Pritikin was issued U.S. Pat. Nos. 2,910,766 and 3,056,937 in which he disclosed a method of producing an electrical component, such as a resistor, wherein the component was constructed of two sheets of preformed and prefired glass. One of the sheets was grooved at opposite ends to receive conducting leads. The other sheet had on one or both of its principal surfaces the desired electrical element. The two sheets of glass were cemented or otherwise secured together in face-to-face relationship, whereby the leads were firmly held in place between the two sheets of glass and in contact with the resistive layer. The preferred embodiment of Pritikin was stated to be one that had the resistance element on one of the concealed surfaces only. It is to be noted that Pritikin disclosed a glass substrate which in effect is a prefired substrate for supporting a resistor film and a terminal cover member. All of his operations were done separately.

Other patents have issued from time to time in the cermet or thick film field but, in the main, these patents have related to variations in metallic constituents and differing glass frits or fluxes to provide higher or lower resistance values, better TCR's (Temperature Coefficient of Resistance), lower current noise and other refinements directed to specific applications and functional specifications. These are exemplified, for instance, in the well-known Place et al U.S. Pat. Nos. 2,950,995 and 2,950,996, as well as the so-called "Birox" thick film glass containing bismuth as taught in U.S. Pat. No. 3,816,348 granted to Popowich.

The Buzard et al U.S. Pat. No. 3,648,363 introduced a cermet resistor, wherein conductor material in the form of a silver, palladium glass frit was first deposited upon a prefired aluminum substrate. A pliable, self-supporting film of resistive material was attached to the conductive layer and the entire unit was fired to mature each of the conductive and resistive layers.

Pritikin U.S. Pat. No. 2,796,504 also suggested simultaneously curing conductive and resistive layers of thermosetting plastic material. These layers were supported, however, with a backing of previously cured thermoset layers. A similar technique was disclosed in the U.S. Pat. No. 2,745,931 granted to Heibel. Heibel also used plastic thermosetting material supported by means of a fibrous tape of paper or textile.

A co-firing technique for cermet type resistors is suggested by Cocca in U.S. Pat. No. 3,699,650. However, in this case, only a resistive layer on a prefired substrate and protective glass coating are the only co-fired elements.

A glass substrate formed with suitable binder surrounding embedded leads was disclosed in Loose U.S. Pat. Nos. 3,584,379 and 3,626,353. The substrate and leads were fired together but, here again, the resistive layer was applied separately on the external surface of a prefired body.

It will be apparent that in each of the prior art devices, the substrate is separately fired and is usually of high temperature material, such as steatite or alumina, and of a configuration requiring relatively complex forming and terminating procedures.

SUMMARY OF THE INVENTION

The present invention relates to electrical resistors and, particularly, to those of the cermet or thick film type deposited upon an insulating substrate and the attachment of suitable lead wires for making connection thereto. The invention is directed to both fixed resistors and to the resistor-collector track component of variable resistors. A preferred embodiment of fixed resistors of this invention is derived from a pair of substantially identical injection molded preforms, each of which contains a plurality of half-shell moldings and upon one of which there is provided a substrate surface for receiving a deposition of termination and resistance materials. The other preform is arranged to provide a molded, mating cover of half-shell configuration for adhesive attachment to the prior described substrate molding after positioning and securing the axially extending lead wires. Injection molding permits a multitude of substrates and covers to be molded as a unit comprising a plurality of spaced strands, each of which are readily severable into individual half-shell moldings. The preform containing the moldings, which are later fabricated into cover and substrate members, is adaptable for facile handling and fixturing for purposes of support during the period of application of termination areas and the application of thick film resistance layers. Such application may be by means of screen printing or other suitable means of deposition. The specific preform configuration also lends itself to ease in separation of individual cover and substrate for later burn-out, firing and trimming operations.

Another equally important feature of the present invention lies in the provision of a composite electrical resistor element, in which a substrate of insulating material may be injection molded, or otherwise formed of a suitable ceramic-glass matrix material. The substrate is arranged to receive, in the "green" or unfired state, depositions of termination and resistance layers. Organic binders and lubricating materials are subsequently burned out of the unfired substrate and of the deposited layers as a unit, and the entire unit is co-fired, including the substrate and its respective deposited termination and resistive layers.

The preferred fixed resistor configuration is cylindrical in form and is provided by adhesively joining together, after firing and attaching leads, the aforementioned half-shell substrate and cover moldings. The substrate half-shell molding includes the termination and resistive layers, as well as the means of retaining and making contact to the axially extending lead wires, and the other half-shell molding is preferably of the same material as the substrate molding, and is burned out and fired under substantially identical conditions as the substrate molding. This procedure provides a finished device of compatible mating pieces having substantially identical physical-chemical characteristics. Because the adhesively joined half-shell moldings are of substantially identical configuration and size, the finished resistor requires little or no surface finishing. No conformal insulating coating is required, as the resistance elements are contained between the cover and substrate moldings. Conventional indicia or color banding equipment may be used to properly identify the finished resistor.

It will become apparent from the ensuing description that the configuration of the present invention provides an electrical resistor element meeting functional specifications and requirements associated with conventional thick film resistors. The improved resistor may be facilely manufactured at a considerably reduced cost compared to prior art devices, permitting a single burnout and a single firing of an injection molded substrate, along with predeposited resistive and conductive layers. Since the cover molding of the fixed resistor is of the same material and fired under the same conditions, there is minimal problem of mismatch as far as mating dimensions are concerned. Further, the finished device requires minimal or no surface treatment after the parts have been joined together.

Accordingly, among the objects of the present invention is the provision of a thick film or cermet resistor element having the advantages of previous resistors of the same type, and which further provides a resistor element of improved configuration and a facile method for making the same, wherein costs of manufacture, simplification of apparatus for manufacturing and cost of materials are greatly reduced when compared with conventional resistors.

BRIEF DESCRIPTION OF THE DRAWINGS

FIG. 1 is a perspective view, partially in section, illustrating a typical fixed resistor manufactured in accordance with the present invention;

FIG. 2 is a top plan view of an injection molded preform containing a plurality of units which may be utilized interchangeably as either substrate moldings for supporting resistive and termination elements, or as cover moldings for the substrates in the fabrication of fixed resistors in accordance with the present invention;

FIG. 3 is a fragmentary, enlarged view taken from a portion of the top plan view of FIG. 2;

FIG. 4 is a fragmentary longitudinal sectional view taken along lines 4—4 of FIG. 3;

FIG. 5 is a cross-sectional fragmentary view taken along lines 5—5 of FIG. 3;

FIG. 6 is a fragmentary perspective view of a plaque member used for supporting the molded preform of FIGS. 3-5, inclusive, prior to separation of individual substrate and cover members during operations performed prior to firing of the members;

FIG. 7 is a longitudinal sectional view, similar to the view of FIG. 4, but illustrating a substrate molding with the termination material applied;

FIG. 8 is a longitudinal sectional view, similar to the view of FIG. 7, with the resistive coating applied to the substrate molding and also covering a portion of the previously applied termination material;

FIG. 9 is a fragmentary top plan view of a section of the preform substantially comparable to the section of FIG. 8;

FIG. 10*a* is a perspective view of a half-shell substrate molding, and illustrating the molding after separation from the molded preform and following deposition of the termination and resistive materials and preparatory to co-firing of the individual moldings;

FIG. 10*b* is a perspective view of a half-shell cover molding after having been separated from the molded preform burned out and fired;

FIG. 11 is a perspective view of the substrate molding of FIG. 10*a* with solder washers disposed at oppositely disposed cavities preparatory to joining the half-shell substrate molding with axially extending lead wires;

FIG. 12 is a perspective view of the substrate half-shell molding with the axially extending lead wires joined thereto;

FIG. 13 is a perspective view of the completed resistor unit with the cover molding of FIG. 10*b* adhesively applied to the substrate molding to form the cylindrically configured resistor component;

FIG. 14 is a perspective view of a substrate supporting a resistive track, a collector track and termination areas used as an element of a rotationally operated variable resistor made in accordance with the present invention;

FIG. 15 is a perspective view of a substrate element used in the assembly of rectilinear variable resistor devices made in accordance with the present invention;

DESCRIPTION OF THE PREFERRED EMBODIMENTS

Figure 16:
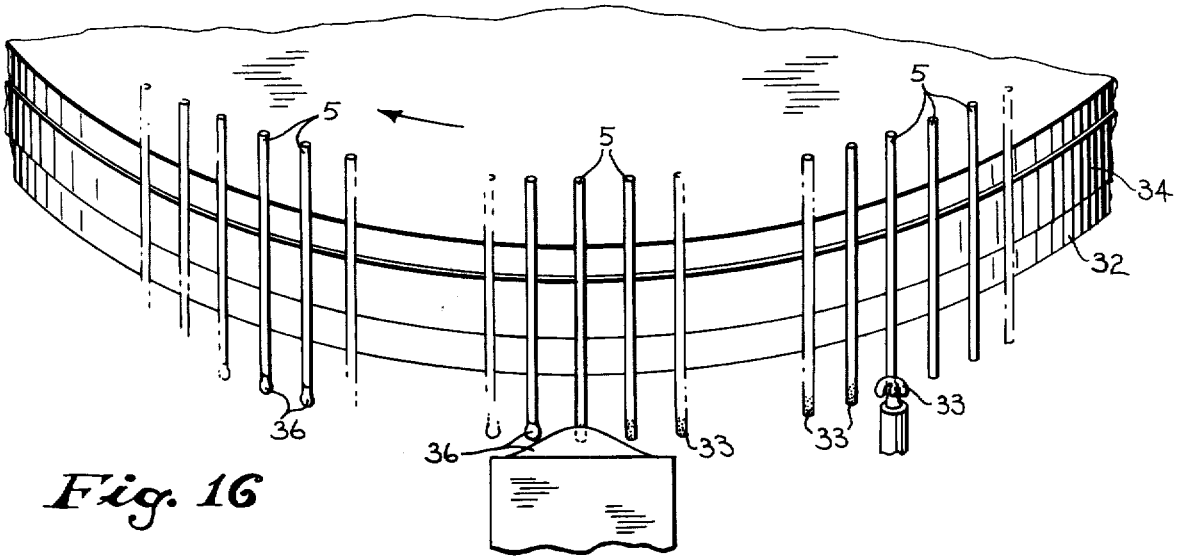
FIG. 16 is a fragmented perspective view illustrating a means of applying a solder coat to one end of respective termination leads prior to fastening said leads to the substrate.

The first embodiment of the present invention relates to a fixed resistor element, whereas other embodiments disclose variable resistor elements. With reference to FIG. 1, the fixed resistor is indicated generally by the reference numeral 1. The resistor 1 comprises a half-shell substrate molding 2 and a complementary half-shell cover molding 3. Each of the moldings 2 and 3 is provided with re-entrant cavities 4 at opposite ends of the resistor 1. The opposed cavities are arranged to receive axially extending terminal leads 5. The substrate molding 2 is provided with a resistive layer 6 deposited on the flat surface 8 of the substrate molding 2 and connecting at opposite ends with a previously deposited termination area 7. The deposited layer of area 7 extends into the groove 4 and into contact with a solder layer 9.

With reference to FIGS. 2–5, it will be apparent that the mating moldings 2 and 3 may each be formed from an injection molded preform 10. The preform 10 is configured to provide a plurality of the substantially identical moldings 2 and 3, and comprises oppositely disposed tie bars 11 supporting integrally formed, longitudinally extending molding strands 12. In the presently described embodiment, the molding strands 12 are laterally spaced and semicircular in cross section (see FIG. 5). The injection molded preform 10 includes in each of its molding strands 12 a plurality of longitudinally spaced, cavities 13 configured as shown in FIGS. 3–5, inclusive. The cavities 13 provide opposed lead-receiving, re-entrant cavities 4 after severing the strands 12 into separate moldings 2, 3, as will hereinafter be described. It is preferable to provide a chamfered shoulder portion 14 at opposite ends of the groove (see FIG. 4), in order to avoid a sharp edge when laying down a deposit of termination material as will hereinafter be described.

The configuration of the preform 10 of FIG. 2 provides a pliable construction, permitting ease in assembling to a temporary holding fixture, or plaque 20 (see FIG. 6). The spaced strands 12 also provide a pliable means of handling the member during deposition and cutting steps, as will be described.

With reference to FIG. 6, the plaque 20 may be formed of a solid metal, such as an aluminum or zinc die casting, or may be any of a number of thermosetting or thermoplastic, filled or nonfilled plastics. The plaque 20 includes a transverse groove 21 for receiving a respective tie bar 11 of the molded preform 10. A series of laterally spaced, longitudinal grooves 22 are provided to receive the respective molding strands 12. The grooves 22 are preferably dimensioned to conform to the outer dimension of the respective strands 12 (in this case, semicircular) to provide a surface substantially flush with the exposed surface of the strands 12. This provides a support for silk screening operations. The plaque 20 is further provided with a series of longitudinally spaced grooves 23 for receiving a molding cutter, such as a knife or saw blade or other cutting devices 24, used for separating each of the molding strands into individual substrate or cover moldings 2, 3. When materials and conditions permit, the strands 12 may be scored (not shown) for dividing and separating the moldings 2, 3.

The preform 10, from which the several substrate moldings 2 are provided, is seated in a respective plaque 20 for further handling prior to severing and firing (see FIG. 7). The material defining the termination area 7 and termination cavity 4 is laid down by a silk screen applicator or other suitable means arranged to deposit the termination material in each of the various depressions 13 of the preform 10. It is preferred in most cases to silk screen the termination land area 7 separately from the lead cavity 4, although it is conceivable that both the cavity 4 and the land area 7 may be applied at the same time utilizing the same material. The land area 7 material is preferably a metallic silver suspended in a resin solution, the composition of which will be later described. Although a silver powder is preferred, a palladium-silver powder or other solderable metal powder may be used for termination and is suspended in a resin solution. The deposited termination materials are dried in a circulating air oven or continuous belt oven for approximately 1 to 20 minutes at 90° C.±5° C.

After the termination material has been deposited and dried, the resistor material 6 is deposited on the surface 8 to overlap the land areas 7 of the termination material (see FIG. 8). This material may also be deposited by known silk screening techniques. The material is of the commonly known "cermet" or "thick film" type, but specifically chosen to be compatible and is capable of being co-fired with the termination material(s) and the substrate material.

The controlling factor in the technique of manufacturing the present resistor is the melting or alloying temperature of the termination materials. Both the substrate material and the resistive material are selected to "fire" at the sintering temperature lower than the melting point or alloying temperature of the metallic termination material(s).

Examples of matching termination, resistive and substrate compositions which have been successfully co-fired in accordance with this invention are as follows:

EXAMPLE I

Termination Material

DuPont Silver Termination No. 7713

This material was commercially obtained and required no further treatment nor modification. The material was mixed or agitated into uniform suspension of the silver particles in the vehicle. The suspension was applied directly to the cavities 13 and land areas 7 by either silk screening or by other suitable transfer techniques. The termination layer 17 was next dried in place on the strands 12 in a circulating air oven for approximately 20 minutes at 90° C.±5° C. or in a continuous belt oven for 12 minutes at a peak temperature of 105° C.±5° C. It is to be understood that experience will indicate that in certain instances it may be desirable to coat the land areas 7 independently of the cavities 13.

The melting or alloying temperature of the termination layer 17 or layers controls the maximum upper temperature during co-firing. Silver, as a termination material, is generally preferred because it is a very satisfactory electrical conductor. It is compatible with soldered leads and the selected resistive material, and is very economical to use. As a practical matter, the preferred firing temperature range of approximately 840° C.–925° C. (the melting temperature of silver is 960.8° C.) was selected to accommodate various resistive pastes that are within the state of the art, and also to provide greater latitude in selecting materials and handling of the cermet body during firing. Thus, the materials constituting the body 2 and the resistive layer 6 are chosen to be compatible with one another and to fire to a set temperature, determined by preselected electrical parameters. Accordingly, a substrate molding and cover molding formulation compatible with the above termination material is as follows:

| Substrate and Cover Member Formulation: | Weight Percentage |
|---|---|
| Talc $[(OH)_2Mg_3(Si_2O_5)_2]$ | 14.0 |
| Silica $(SiO_2)$ | 28.3 |
| Alumina $(Al_2O_3)$ | 14.0 |

-continued

| Substrate and Cover Member Formulation: | Weight Percentage |
|---|---|
| Lead Alumina Borosilicate | 29.7 |
| Parafin Wax | 8.4 |
| Carnauba Wax | 2.25 |
| DuPont El Vax 250 (Ethylene/vinyl acetate copolymer) | 3.35 |
| | 100.00 |

The various substrate ingredients were weighed, mixed, and then further mixed at a temperature sufficient to melt the wax base so that a good dispersion of the dry ingredients and the melted wax can be made. Upon cooling to a temperature below the melting temperature of the wax, the material may be broken up, ground, or granulated by any suitable means, such that the material will pass through a four-mesh screen. The said processed powder is then available for processing in a conventional injection molding machine. Upon completion of the molding cycle, the molded preform 10 is removed and placed in the supporting fixture or plaque 20 for further processing (see FIG. 6). Although injection molding techniques are preferred, other forming techniques such as extruding and transfer molding may be used with slight adjustments of the binder-to-powder ratio.

It will be noted that the binders comprising the parafin wax, carnauba wax and the ethylene/vinyl acetate copolymer provide a means of gradually dispersing or vaporizing in order to provide a smooth removal prior to sintering the glass components. Parafin will vaporize first, carnauba second and the copolymer will serve to "bind" the removing material until a sufficient amount softens to begin the sintering process.

The molded preform 10 was next seated in the plaque 20 ready for deposition of the termination layers 4 and 7 and the resistive layer 6, as shown in the top plan view of FIG. 9. The land area termination 7 and cavity 13 had deposited thereon the silver termination material described above.

The resistor paste was next applied by conventional silk screen procedures in the resistive area 6 on the surface 8 of the substrate molding 2 (see FIG. 9). The particular composition may be selected from a number of compositions, the formulae of which depend upon the desired resistance value of the resistor. The pattern preferably overlaps the land area termination 7 equally on both ends and extends laterally from each side of center, but stopping short of the opposite edges to provide electrical isolation internally of the adhesively joined moldings 2 and 3 (see FIG. 1). A typical resistance composition that was found to be effective for the co-firing procedure in the present example was as follows:

| Resistance Formulation | Weight Percentage |
|---|---|
| 70% Silver Resinate | 3.6 |
| Ruthenium Dioxide Powder | 10.1 |
| Palladium Metal Powder | 4.2 |
| Lead Alumina Borosilicate | 32.2 |
| Wetting Agent - Triton X-45 (Rohm & Haas) | 0.5 |
| Vehicle (ethyl cellulose in pine oil or butyl carbitol acetate) | 48.2 |
| Doping Agent - $Cr_2O_3$ | 1.2 |
| | 100.0% |

The resistive layer 6 was dried for 1 to 20 minutes at approximately 90° C.

The ingredients and their proportions set forth in the present example, as well as in the remaining examples, are representative of operable embodiments. The art of preparing cermet and termination formulations is well-known. Previously, such formulations or similar formulations have been applied to prefired substrates fired from ceramic materials, such as alumina or steatite. They have been varied to obtain certain characteristics, such as resistivity and conductivity as well as low noise and T.C.R. measurements. For instance, "doping" agents are well described in the literature and in the case of cermet films, they are basically transition metal oxides chosen from groups 4, 5, 6, 7 and 8 of the Periodic Table.

With reference to FIG. 6, it will be apparent that the plaque 20 has been provided with grooves 23 for receiving the saw blade 24 or other cutting or scoring fixtures. The blade or series of blades are arranged to severe the strands 12 centrally of the cavities 13 to provide the individual substrate or cover moldings 2, 3 (see FIGS. 10*a* and 10*b*). It will be apparent that, in the case of cover molding 3 of FIG. 10*b*, the preform 10 for the moldings 3 is merely seated in the plaque 20 for purposes of supporting the strands 12 during the cutting or severing operation.

After the individual half-shell moldings 2, 3 are severed, they are collected and transferred to either a batch burnout oven or they may be loaded directly onto a continuous furnace belt of the proper "mesh" so that the organic materials may be "burned out" and the ceramic body, termination and resistive film may be brought to maturity at the same time on an in-line or continuous belt type furnace. Furnace conditions which have been found to be satisfactory are as follows:

| Belt Speed 9" per minute Zone Temperatures | °C. |
|---|---|
| 1 | 500 |
| 2 | 600 |
| 3 | 700 |
| 4 | Set Temperature |
| 5 | Set Temperature |

It will be apparent that the set temperature will depend on the mixture of materials used in the resistive layers 6 and in the body of the moldings 2 and 3 but is preferably within the range of 840°-925° C. In the embodiment of Example 1, the preferred set temperature was 855° C.

With reference to FIG. 11, it will be observed that the next step in the process is to provide a means of soldering or attaching the axially extending lead wires 5 into the cavities 4. This may be done by any of a number of methods which include: (a) solder dipping the terminated half-shell and reheating or reflowing this solder and the lead, (b) applying the solder in the form of any of the commercially available solder pastes to either the tip of the lead wire or into the lead cavity or both and then reflowing this solder paste to form the solder joint or (c) applying the solder in the form of a solder preform or washer 30 (see FIG. 11) which is placed into the cavity 4 and then reflowed with the lead wire. The solder used may be of any of a number of formulations, but the preferred embodiment is of the high temperature solders, such as 10% tin, 90% lead or 10% tin, 88% lead, 2% silver.

Pilot run operations have revealed that the use of solder preforms such as the washer 30 are relatively difficult to handle and maintain in position during assembly and soldering of termination lead wires 5. With reference to FIG. 16, it will be observed that the lead wires 5 may be fed through a flux reservoir by means of a supporting revolving drum 32. The wires 5 are fed to the drum 32 while being removably held in place on conventional adhesive lead tape 34. Conventional soldering flux 33 is applied to the exposed ends of the wires 5, and the drum 32 is rotated over a solder font 35 to flow solder over the prefluxed ends to form a solder ball 36. As previously stated, the wires 5 are conventionally precoated with a layer of 60% tin-40% lead alloy. The solder ball 36 is preferably formed from a relatively high melting alloy of 10% tin-90% lead solder.

Figure 17:
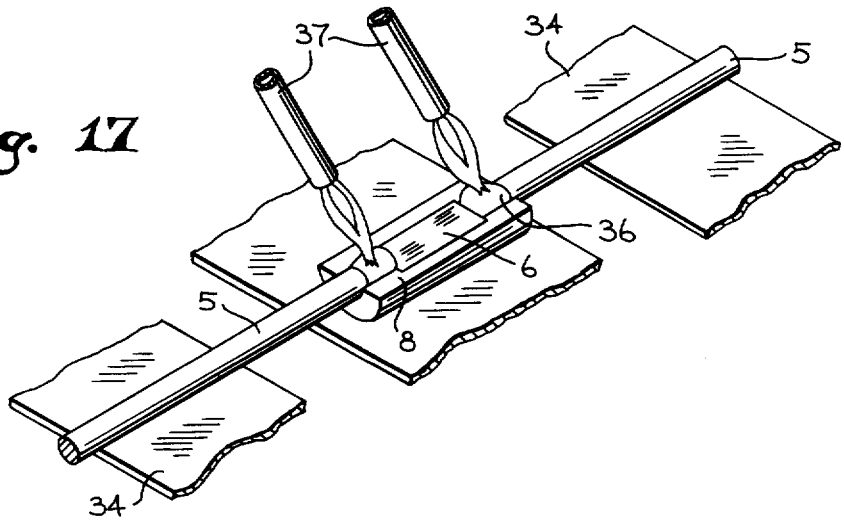
FIG. 17 is a perspective view of a portion of an assembly fixture illustrating the means of soldering the ends of the termination leads to opposite ends of the substrate.

FIG. 17 is illustrative of an improved arrangement for forming the lead wires 5 to the substrate 8. In this case, the ends of the wires 5 bearing the solder balls 36 are respectively seated in the cavities 4 of the substrate 8 and passed under oxy-hydrogen torch 37. The very hot flame melts only the solder ball 36 without disturbing the 60/40 solder coating.

The resistive layer 6 is next adjusted to value. This may be accomplished by mechanical removal of material (not shown), removal of resistive material by laser or electron beam techniques (not shown) where resistance is to be increased after sorting and classifying. It has been further observed, and is a part of the present invention, that the thick film or cermet resistive layer 6 may be adjusted by further heat treatment, prior to placement of leads, without requiring further mechanical removal of material (not shown). There may be times, however, when both adjusting means may be used. It will be readily observed that such heat treatment will permit the use of simple sorting and classifying of resistors according to value. Those that are found to be under value may then be heat treated to adjust resistance.

Figure 18:
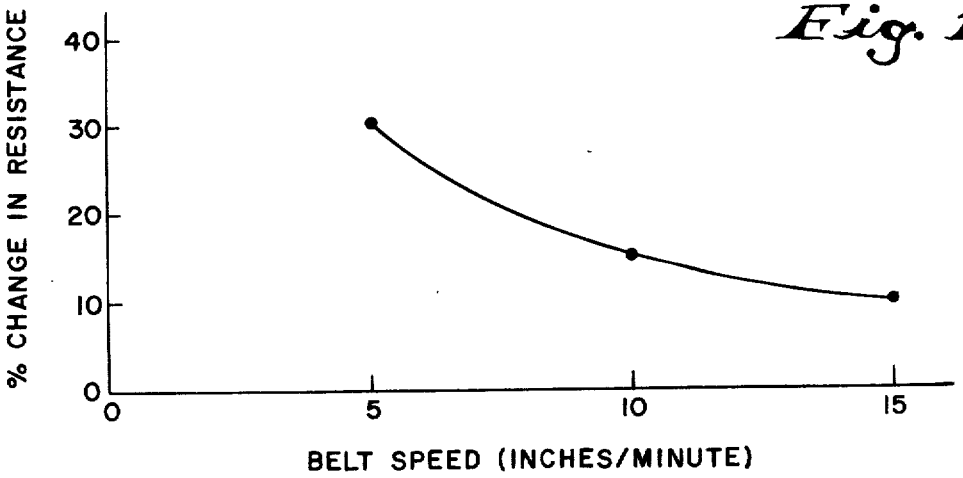
FIG. 18 is a typical graph used in selecting furnace belt speeds to achieve change in resistance after sorting and classification.

For example, with reference to the choice of thick film resistor inks as described in Examples III and Example IV, as hereinafter described, the heat treating or adjusting temperature for a batch of presorted resistors may remain fixed at 750° C. It is highly desirable to maintain the same temperature from a manufacturing cost and scheduling viewpoint. The furnace belt speed may then be adjusted to vary the time of exposure to the adjusting temperature. In the case of Example III resistors, and with reference to FIG. 18, where the target resistance is 1 Megohm, those resistors that have been presorted and classified at 750K ohms (requiring a 30% change) may have their resistance raised to 1 Megohm upon exposure to 750° C. at a belt speed of 5 inches per minute. Presorted and classified resistors of less resistance may be adjusted to the desired resistance of 1 Megohm by slowing the belt speed. The operator may merely refer to the schedule as illustrated by the graph of FIG. 18. In Example IV, should 240K ohm resistance be desired, preclassified and sorted resistors of a value of 185K ohms may be adjusted to the 240K value by subjecting this sorted group to 750° C. at a belt speed of 3½ inches per minute. (No graph shown).

Should the belt speed be too slow, the silver termination layer will tend to migrate and deleteriously affect the resistive layer 6 and the connection with the respective lead wires 5. Increased speed will merely prevent the resistive layer 6 from being adjusted to the desired end value.

The cover molding 3 was then adhesively applied to the substrate molding 2. A satisfactory adhesive may be chosen from any of the organic or inorganic formulations having suitable electrical and physical properties. The adhesive may be placed on only one or both of the parts, but preferably on the first surface of the substrate molding 2 after the leads 5 have been attached. The top or cover molding 3 is then placed over the adhesive covered substrate molding 2 and the parts are adhesively attached. One example of an acceptable adhesive would be "UNISET" A-316 made by Amicon Corporation. If the adhesive has been properly applied and in the proper amount, there will be little or no "flash" or other material found exteriorly of the mated moldings as shown in FIG. 13.

The parts are then transported to a color banding machine (not shown) for application of conventional and accepted axially spaced bands of colored paint, or may instead be alphanumerically marked, which identifies the values and other information in accordance with conventional and accepted specifications.

In the present example, the finished resistor 1 had the following properties:

| | |
|---|---|
| Resistance value | 1.2K ohms |
| T.C.R. (room temperature to 150° C.) | 150 ppm/°C. |
| After aging at 125° C. for 1,000 hours | +0.25% change in resistance |

Example 1 illustrates the use of a commercially purchased silver termination paste with a typical "ruthenium dioxide" type cermet. Example 2 is presented to illustrate the use of a prepared silver termination paste and a typical "palladium-silver" type cermet.

EXAMPLE II

This example relates to the preparation of a cermet film of the "palladium-silver" type, providing a composition that may be fired at a lower temperature; namely, in the neighborhood of 850° C.

| | | |
|---|---|---|
| Termination: | Silflake 135 from Handy and Harmon or Type "P" silver from Engelhard | |
| Cermet Formulation: | | Weight Percent |
| Ingredient A. | 13.5 Ruthenium Resinate | 69.4 |
| | 20% Palladium Resinate | 23.1 |
| | Lead Alumina Borosilicate | 7.5 |
| | | 100.0% |
| Ingredient B. | Alloy of 44/56 Palladium Silver | 85.0 |
| | Lead Alumina Borosilicate | 15.0 |
| | | 100.0% |

| Composition | Weight Percent |
|---|---|
| Ingredient A | 13.2 |
| Ingredient B | 47.2 |
| Vehicle (ethyl cellulose in pine oil or butyl carbitol acetate) | 37.8 |
| Wetting agent (Triton X-45) | 0.5 |
| Doping agent - Chromium Oxide ($Cr_2O_3$) and Manganese Silicide | 1.3 |
| | 100.0% |

| Substrate and Cover Member Composition: | Weight Percent |
|---|---|
| Alumina ($Al_2O_3$) | 4.7 |
| Talc [$(OH)_2Mg_3(Si_2O_5)_2$] | 10.7 |

-continued

| | |
|---|---|
| Lead Alumina Borosilicate | 33.8 |
| Silica ($SiO_2$) | 34.2 |
| Brown Coloring Pigment ($Fe_2O_3$) | 1.9 |
| Parafin Wax | 10.1 |
| Du Pont El Vax 250 (ethylene/vinyl acetate copolymer) | 4.6 |
| | 100.0% |

In the present example, the substrate (including termination and resistive layers) and the cover moldings 2 and 3 were burned out in a manner similar to the method of Example I, except that they were fired at a set temperature of 850° C. Otherwise, the materials and assemblies were processed in the same manner as the resistor element of Example I.

The resultant properties of the fixed resistor 1 made in accordance with the Example II were:

| | |
|---|---|
| Resistance value | 75 ohms |
| T.C.R. (room temperature to 155° C.) | +155 ppm/°C. |
| After high temperature aging at 155° C. for 1,000 hours | +0.42% change in resistance |

EXAMPLE III

This example provides a device which illustrates that a "lead ruthenate" or "pyrochlore structure" type of cermet may be co-fired.

| | |
|---|---|
| Termination Composition: | Types "G" and/or "E" silver suspension obtained from Metz Metallurgical Corporation |
| Cermet Formulation: | Weight Percent |
| Lead Ruthenate Powder ($Pb_2Ru_2O_6$) | 40.0 |
| Lead Borosilicate Glass | 25.0 |
| Titania ($TiO_2$) | 5.0 |
| Vehicle (ethyl cellulose in pine oil or butyl carbitol acetate) | 29.5 |
| Wetting agent (Triton X-45) | 0.5 |
| | 100.0% |
| Substrate and Cover Member Formulation: | Weight Percent |
| Alumina ($Al_2O_3$) | 14.0 |
| Talc [$(OH)_2Mg_3(SiO_5)_2$] | 14.0 |
| Silica ($SiO_2$) | 28.3 |
| Lead Borosilicate | 29.7 |
| Parafin Wax | 10.5 |
| Du Pont El Vax 250 (ethylene/vinyl acetate copolymer) | 3.5 |
| | 100.0% |

The cover molding 3 and the substrate 2, including its termination and resistive layers, were burned out and fired in a manner similar to Example I, except that the set firing temperature was 875° C.

The resultant properties of the fixed resistor 1 made in accordance with Example III were:

| | |
|---|---|
| Resistance value | ≈ 1 Megohm |
| T.C.R. (room temperature to 155° C.) | −380 ppm/°C. |
| After high temperature aging at 155° C. for 1,000 hours | +0.24% change in resistance |

Doping agents have not heretofore been particularly described but, for the main, they are basically selected from transition metal oxides or compositions that will form oxides during firing and of elements from Groups 4, 5, 6, 7 and 8 of the Periodic Table. The use and variation of such agents are known and provide for changes in resistance, viscosity and shifts in T.C.R.

It is to be reiterated that the choice of materials is broad. For instance, the termination material may be the criteria upon which the molding formulation and the termination is based. In such case, as has been disclosed in the above examples, silver was selected because of its excellent conductivity. Obviously, the set firing temperature of the co-fired unit must be maintained below the softening temperature of silver. However, should certain resistance or other characteristics, such as ease of trimming become of such importance that proper control of the resistive layer would require a higher firing temperature, the silver may be alloyed with another metal to soften at a higher temperature, or another metal of higher melting temperature may be substituted. Palladium would be suitable.

The examples set forth are representative of traditional cermet compositions used in thick film resistor manufacture and do illustrate that the traditional "ruthenium dioxide", the "palladium-silver" and the "pyrochlore structure" type cermets may be used as a basis for fabricating resistors of the fixed and variable types.

EXAMPLE IV

Further study of the present concept has also revealed that the preforms 10 may also be prefired at a relatively low temperature (775° C. in the case of the materials of Example III) in conventional "bisque" firing furnaces prior to deposition of the termination and resistive layers 6 and 7. Here, the relatively low temperature firing volatilizes, decomposes and removes organic binder materials from the moldings 2, 3, in addition to providing sufficient heat to partially sinter the ceramic for structural strength during the deposition of layers 6 and 7.

The resistor formulation involved in the example was of the lead ruthenate type, similar to Example III; i.e.,

| Cermet Formulation: | Weight Percent |
|---|---|
| Lead Ruthenate Powder ($Pb_2Ru_2O_6$) | 40 |
| Lead Borosilicate Glass | 60 |
| | 100% |

70%, by weight, of the lead ruthenate and glass formulation was suspended in 30%, by weight, of a vehicle of ethyl cellulose in butyl carbitol acetate. No dopant was needed in this particular formulation.

The cermet formulation was deposited on a prefired substrate which, prior to this initial firing, comprised:

| | Weight Percent |
|---|---|
| Alumina Powder ($Al_2O_3$) | 14.0 |
| Talc | 14.0 |
| Silica | 28.3 |
| Lead Borosilicate Glass | 29.7 |
| Parafin Wax | 10.6 |
| Du Pont El Vax 250 | 3.4 |

-continued

| | Weight Percent |
|---|---|
| | 100.0% |

The termination layer was a Type "G" silver suspension obtained from the Metz Metallurgical Corporation.

The termination layer 17 and the resistive layer 6 were deposited on the substrate molding 2 in the same manner as set forth above. After deposition on the prefired substrate molding, the molding 2 and its layers 6 and 17 were placed in an oven or burnout zone for removing organic materials from the deposited layers. The units were then finally fired at a set sintering temperature of 860° C.

The present formulation resulted in a resistance value of 212K ohms with a T.C.R. (room temperature to 155° C.) of +170 ppm/°C. It is to be noted that "control" parts fired in the usual manner, viz. deposition of layer 6 and 7 on green, unfired substrates 2 of the same formulation, had a value of 224K ohms and a T.C.R. of +194 ppm.

The relatively low temperature or bisque prefire of substrates and cover moldings 2 and 3 removes substantially all of the organic material. This adds versatility to the entire concept. For instance, resistive layers are very thin and can, under certain conditions, be disrupted by volatiles and products of decomposition during burnout of the relatively larger quantities of organics emitted from the substrate 2. Also, certain resistive compositions may be affected by chemical action, such as oxidation, caused by contact with the emitted substrate organic materials. These problems are minimized by the prefire operation.

Such operation also permits the use of conventional, economically operated, bisque type furnaces and supporting hardware. At the same time, the present example encompasses the advantages of the co-fired final sintering operation. This relatively expensive high temperature firing may be performed during a single operation to co-fire the substrate simultaneously with its deposited resistive and termination layers.

It will be understood that the term "bisque" is intended to be used in its broadest sense; i.e., as a prefire prior to laying down resistive and termination layers which are later co-fired with the substrate.

By way of indicating the general versatility of the present invention, it will be observed from the illustration and description of the embodiments of FIGS. 14 and 15 that the invention may be applied to variable resistance devices.

Referring to FIG. 14, there is illustrated a resistive element 40 comprising an insulating supporting substrate 41. The substrate 41 supports a first contact surface in the form of a fired-on, arcuate, printed resistive track 42, preferably of a cermet material, the composition of which is set forth below. Opposite ends of the resistive track 42 terminate at termination pads 43. The element 60 further supports a second contact surface in the form of a collector track 44 comprised of a highly conductive material. The material is preferably the same as the termination material, particularly in the case of trimmers in which the contact brush (not shown) is moved only a few times during the life of the device, However, in certain cases, such as in potentiometers, the collector material may be of a glass matrix heavily loaded with conductive particles. The glass matrix material and particles are compatible with the substrate material and are also co-fireable therewith. The track 44 is preferably in the form of a fired circular pattern concentric with the center of the arcuate resistive track 42. The collector track 44 extends to a termination pad 45.

The element 40 is defined in greater detail in connection with the adjustable electronic component described and claimed in the U.S. Pat. No. 3,445,802 granted to Robert W. Spaude, and assigned to the same assignee as the present invention.

U.S. Pat. No. 3,445,802 further defines a lead screw adjusted component, here illustrated in the embodiment of FIG. 15. The component includes a supporting base 50 molded of a thermosetting plastic material. The base 50 supports a resistive element 51, which comprises a rectangularly-shaped substrate comprised of a material which is described below and like the material of the substrate 41 of FIG. 14 and the moldings 2, 3 of the fixed resistor embodiment of FIG. 1, may be co-fired with the cermet resistive track 53, the conductive collector track 54 and the termination pads 55 on the resistive track 53 and pad 56 on collector track 54. The leads 57 and 59 extending through and supported by the substrate 52 are solder connected respectively to the termination pads 55. Lead 58 is solder connected to the pad 56 of the collector track 54. A detailed description of the assembly is set forth in U.S. Pat. No. 3,445,802.

In the variable resistor embodiments of FIGS. 14 and 15, the "pyrochlore structure" cermet of Example III was found to provide desired results. That is, the termination pads and collector tracks 44 and 54 were formed of Type "G" or "E" silver prepared and sold by Metz Metallurgical Corporation. The respective substrates 41 and 52 of a talc loaded, lead borosilicate glass and the respective resistive tracks 42 and 53 of the "pyrochlore ruthenate" structure.

The present invention provides fixed and variable electrical resistor elements of the thick film or cermet type which incorporates the various attributes of conventional cermet resistors and which further discloses a method of making resistors wherein the termination, the resistive layers and the body may be co-fired at the same temperature. In the case of fixed resistors, two substantially identical half-shell moldings are adhesively joined to provide an integrated unit having similar physical and thermal characteristics. Need for a conformal insulating coating is eliminated and the device may utilize conventional color banding techniques. It will be apparent that there is a large savings in cost as well as energy during firing of the resistor units in adopting the "co-fired" principle of this invention.

The embodiments of the invention in which an exclusive property or privilege is claimed are defined as follows:

1. A method of forming a resistor element having a substrate member, a metallic termination layer and a resistive layer, said layers deposited on preselected areas of said substrate member, said method comprising the steps of:

selecting a metallic, conductive termination material with a given softening temperature, said metallic material being dispersed in an organic vehicle;

selecting a resistive composition comprising discrete electrically conductive particles, glass forming materials providing a matrix for supporting said conductive particles, and an organic binder material for temporarily supporting said particles and glass forming materials in the green state during deposition and prior to sintering, said resistive composition having a sintering temperature below the softening temperature of said conductive termination material;

selecting an insulating substrate composition comprising a mixture of ceramic-glass forming materials having a sintering temperature below the softening temperature of said conductive termination material, and an organic binder material for temporarily supporting said ceramic-glass forming materials in the green state prior to sintering;

forming said insulating substrate member from said substrate material to provide a surface for receiving and supporting a layer of said termination material and a layer of said resistive composition;

depositing a layer of said metallic conductive termination material on at least a portion of said formed unfired substrate member;

depositing a layer of said resistive composition on a portion of the supporting surfaces of said unfired substrate member, said termination layer and said resistive layer being in contact with one another and said termination layer adapted to connect said resistive layer to an electrical circuit; and removing the said organic vehicle and binder materials from said formed substrate member, said deposited termination layer and said resistive layer prior to co-firing said substrate member and said layers; and co-firing said formed substrate member and its deposited metallic termination and resistive layers to simultaneously sinter said resistive layer and said substrate member.

2. The method of claim 1, wherein the termination material is metallic silver and the glass forming materials of the substrate and of the resistive layer are lead borosilicate glasses having a sintering temperature below the melting point of said silver termination material.

3. The method of claim 1, wherein the conductive particles of the resistive layer are essentially ruthenium dioxide.

4. The method of claim 1, wherein the conductive particles of the resistive layer are essentially a palladium-silver mixture.

5. The method of claim 1, wherein the conductive particles of the resistive composition include a pyrochlore structure combined with a glass matrix.

6. The method of claim 5, wherein the pyrochlore structure of the resistor composition comprises lead ruthenate.

7. The method of claim 1 further including the steps of injection molding a preform of said substrate composition, said perform including a plurality of elongated, parallel spaced strands joined at at least one end by a transverse tie bar; seating said preform in a supporting fixture; depositing said termination layers and said resistive layers on said strands while seated in said fixture; and dividing each of said strands into a plurality of substrate members prior to removal of the organic vehicle and binder materials and prior to co-firing of said members and their respective layers.

8. The method of fabricating a fixed resistor in accordance with the method of claim 7, which further includes the steps of injection molding a cover member of substantially identical composition as the said ceramic-glass forming substrate material, and heating said formed cover member to burn out the organic materials and to sinter the ceramic-glass forming materials at substantially the same conditions as that of said substrate composition, depositing a solder layer on a portion of said metallic termination layer, anchoring spaced apart leads to respective surface areas of said deposited solder layer of said substrate member, and joining together said substrate member and said cover member to enclose said termination and resistive layers.

9. The method of claim 1, wherein the said termination and resistive layers are deposited directly on said formed substrate member, heating said layers and said substrate member simultaneously to remove said organic vehicle and said organic materials and co-firing said layers and substrate member to simultaneously sinter said resistive layer and said substrate member.

10. The method of claim 1, wherein the substrate member is prefired prior to deposition of said conductive termination layer and said resistive layer to remove the organic materials from said substrate member and to partially sinter said substrate member prior to deposition of said layers and prior to co-firing said substrate member and said deposited layers.

11. The method of claim 8, wherein the said leads are precoated throughout their length with a solder having a predetermined melting temperature and the solder applied to the anchored ends is deposited over said precoated solder and is selected to melt at a relatively higher temperature than the precoated solder.

* * * * *